US010307883B2

(12) United States Patent
Nakamura et al.

(10) Patent No.: US 10,307,883 B2
(45) Date of Patent: Jun. 4, 2019

(54) FINISHING METHOD AND POLISHING MATERIAL FOR PAINTED SURFACE

(71) Applicant: 3M INNOVATIVE PROPERTIES COMPANY, St. Paul, MN (US)

(72) Inventors: Yoko Nakamura, Tokyo (JP); Norikazu Maeda, Tokyo (JP); Toru Aoki, Kanagawa Prefecture (JP)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 15/308,205

(22) PCT Filed: May 27, 2015

(86) PCT No.: PCT/US2015/032529
§ 371 (c)(1),
(2) Date: Nov. 1, 2016

(87) PCT Pub. No.: WO2015/183861
PCT Pub. Date: Dec. 3, 2015

(65) Prior Publication Data

US 2017/0100818 A1 Apr. 13, 2017

(30) Foreign Application Priority Data

May 27, 2014 (JP) ..... 2014-109165

(51) Int. Cl.
*B24B 37/24* (2012.01)
*B24D 3/28* (2006.01)
(Continued)

(52) U.S. Cl.
CPC ..... *B24B 37/24* (2013.01); *B24B 19/22* (2013.01); *B24B 27/033* (2013.01); *B24D 3/28* (2013.01)

(58) Field of Classification Search
CPC ..... B24B 37/24; B24B 19/22
(Continued)

(56) References Cited

U.S. PATENT DOCUMENTS 5,910,471 A 6/1999 Christianson
5,928,394 A 7/1999 Stoetzel
(Continued)

FOREIGN PATENT DOCUMENTS

CN 102515230 6/2012
JP 2001179590 7/2001
(Continued)

*Primary Examiner* — George B Nguyen
(74) *Attorney, Agent, or Firm* — Aleksander Medved

(57) ABSTRACT

PROBLEM: To provide a finishing method for a painted surface that can reduce the number of processing steps, and that can shorten the finish polishing time and reduce the polishing area. RESOLUTION MEANS: The painted surface finishing method of an embodiment of the present disclosure includes a step of removing irregularities in a painted surface using a polishing material including a polishing layer with a structural surface where a plurality of three-dimensional elements are arranged, and providing a surface suitable for finish polishing; and a step of finish polishing the surface; wherein the polishing layer contains abrasive diamond particles with an average particle diameter of 0.5 to 5 μm, and a binder containing an epoxy resin.

8 Claims, 4 Drawing Sheets

(51) Int. Cl.
*B24B 19/22* (2006.01)
*B24B 27/033* (2006.01)

(58) Field of Classification Search
USPC ..... 451/28
See application file for complete search history.

(56) References Cited

U.S. PATENT DOCUMENTS

| | | | | |
|---|---|---|---|---|
| 5,958,794 | A * | 9/1999 | Bruxvoort | B24B 7/228 216/88 |
| 6,565,618 | B1 | 5/2003 | Ishizuka | |
| 6,923,840 | B2 * | 8/2005 | Schutz | B24D 3/004 451/28 |
| 2002/0028264 | A1 * | 3/2002 | Hoopman | B24D 3/28 425/470 |
| 2002/0090891 | A1 * | 7/2002 | Adefris | B01J 13/043 451/28 |
| 2010/0255254 | A1 * | 10/2010 | Culler | B24D 11/00 428/143 |
| 2011/0203185 | A1 * | 8/2011 | Wang | C09G 1/02 51/298 |

FOREIGN PATENT DOCUMENTS

| | | |
|---|---|---|
| WO | WO 98/39142 | 9/1998 |
| WO | WO 2001/045903 | 6/2001 |
| WO | WO 2007/127549 | 11/2007 |
| WO | WO 2008/116043 | 9/2008 |
| WO | WO 2009/085841 | 7/2009 |
| WO | WO 2011/034635 | 3/2011 |

* cited by examiner

FINISHING METHOD AND POLISHING MATERIAL FOR PAINTED SURFACE

CROSS REFERENCE TO RELATED APPLICATIONS

This application is a national stage filing under 35 U.S.C. 371 of PCT/US2015/032529, filed May 27, 2015, which claims the benefit of Japanese Patent Application No. 2014-109165, filed May 27, 2014, the disclosures of which are incorporated by reference in their entirety herein.

TECHNICAL FIELD

The present disclosure relates to a finishing method for a painted surface, particularly an automobile painted surface, using a polishing material, and a polishing material that is used on the painted surface.

BACKGROUND

Polishing materials are used to remove irregularities and to finish automobile painted surfaces. Operations including removing irregularities and surface finishing are also referred to as surface repairing. The term "irregularities (nibs)" refers to protruding parts of paint with a size of approximately 0.5 to 5 mm that are formed by dust in the painting environment or when balls of paint or the like collect on the paint nozzle and adhere as a nucleus to the paint surface. Paint repairing may be necessary not only for painting that is performed when repairing a chassis that has been damaged by an accident or the like, but also when painting new cars, where the occurrence of irregularities cannot be completely prevented.

Paint repairing generally includes three processes, namely removing irregularities, rough polishing, and finish polishing. Removing irregularities generally uses a polishing material with solid granules and an orbital sander. Irregularities can also be removed by a manual operation using a polishing material. Rough polishing and finish polishing are processes of removing fine scratches in the painted surface that occur when removing irregularities to the same appearance as an unpolished painted surface. During rough polishing, a combination of buffing and use of a polishing compound with a large polishing force is used to remove relatively large scratches in a short period of time, and during finish polishing, a combination of buffing and use of a polishing compound with a low polishing force is used to obtain a surface with the target appearance. The polishing tools that are generally used for rough polishing and finish polishing can be a rotary sander and a buffing sander, respectively. For mass appeal vehicles and the like which do not require a high quality finished surface, the rough polishing and finish polishing can be performed in a single process.

Patent document 1 (Japanese PCT (WO) Patent Application No. 2013-505145) discloses "a structured polishing article, comprising: a supporting body having first and second opposite facing main surfaces, and a molded polishing composite body which is an affixed structured polishing layer provided on the first main surface, wherein the molded polishing composite body comprises polishing particles and a non-ionic polyether surfactant dispersed in a cross-linked macromolecular binder, the average particle size of the polishing particles is less than 10 μm, the non-ionic polyether surfactant does not covalently bond with the cross-linked macromolecular binder, and the amount of non-ionic polyether surfactant is 2.5 to 3.5 weight %, based on the total weight of the molded polishing composite body."

Patent document 2 (Japanese PCT (WO) Patent Application No. 2010-522092) discloses "a method of polishing a surface of an object to be processed, comprising: a step of preparing a polishing article attached onto a shaft of a drive tool that provides a polishing surface with attached polishing particles, a step of making contact between a surface of the object to be processed and the polishing surface of the polishing article, and a step of reciprocally rotating the polishing surface of the polishing article around the axis of rotation by reciprocally rotating the shaft of the drive tool, wherein the polishing surface of the polishing article is reciprocally rotated around the axis of rotation, while the surface of the object to be processed is polished by the polishing particles that are adhered to the polishing surface of the polishing article."

Patent Document 1: Japanese PCT (WO) Patent Application No. 2013-505145

Patent Document 2: Japanese PCT (WO) Patent Application No. 2010-522092

SUMMARY

During paint repair, first, a polishing material with sufficient polishing force for removing irregularities must be used. On the other hand, when irregularities are removed using a polishing material with a strong polishing force, a depression is formed because not only the irregularity, but also the area surrounding the irregularity is polished. In order to resolve the appearance defects due to these depressions, normally rough polishing must be performed even on the surrounding area in addition to the area where the irregularity was removed, and thus finish polishing must be performed on an even broader area than the area where the rough polishing was performed. Furthermore, with a deeper depression, the area that requires rough polishing and finish polishing increases, and the polishing time is also increased.

Furthermore, when removing the irregularity, the surface roughness of the ground area will be higher as compared to the unpolished painted surface. Therefore, during rough polishing and finish polishing, the surface roughness created by removing the irregularity must be reduced such that the appearance matches that of the unpolished painted surface. However, if minute roughness on the surface cannot be completely removed by finish polishing that is performed using a combination of a buffing with low polishing force and a polishing compound, diffused reflection of the incident light will be caused by the minute depressions that remain, and there is a possibility of the occurrence of appearance defects known as "whitening". Furthermore, although the theory is not completely understood, other causes of whitening are thought to be that the resin that is used as the paint binder is often softened due to the heat of friction generated on the polishing surface by the rough polishing and the finish polishing over a long period of time, and thus fine scratches that cannot be removed by the finish polishing will occur, or that the resin is thermally degraded. Whitening that is caused by polishing for a long period of time cannot be repaired once it has occurred, and requires repainting.

Therefore, when removing irregularities, it is thought that finish polishing can be performed without rough polishing, and the occurrence of appearance defects such as whitening can be reduced by reducing the surface roughness of the painted surface.

An object of the present disclosure is to provide a finishing method for a painted surface that can reduce the number of steps and shorten the finish polishing time, as well as reduce the area for polishing and improve the quality of the finished surface, and to provide a polishing material that is favorably used for this type of finishing method.

An embodiment of the present disclosure provides a painted surface finishing method, including: preparing a surface suitable for finish polishing by removing irregularities in the painted surface using a polishing material including a polishing layer having a structural surface where a plurality of three-dimensional elements are provided; and finish polishing the surface; the polishing layer including diamond particles with an average particle diameter of 0.5 to 5 μm and a binder containing an epoxy resin.

Another embodiment of the present disclosure provides a polishing material for use on painted surfaces, the polishing material thereof including: a polishing layer having a structural surface where a plurality of three-dimensional elements are arranged, the polishing layer comprising abrasive diamond particles with an average particle diameter of 0.5 to 5 μm and a binder containing an epoxy resin.

According to the present disclosure, the polishing material that is used for removing irregularities provides a surface suitable for finish polishing while removing the irregularities, and therefore finish polishing can be performed without performing rough polishing. Furthermore, rough polishing is not required, so the finish polishing time can be shortened and the polishing area can be reduced. The occurrence of appearance defects such as whitening or the like can be suppressed by shortening the finish polishing time and reducing the area, and as a result, the paint quality can be enhanced.

Note that the foregoing should not be considered as a disclosure of all of the embodiments of the present invention and all of the advantages related to the present invention.

DESCRIPTION OF THE PREFERRED EMBODIMENTS

Representative embodiments of the present invention are described below in greater detail for the purpose of providing examples, but the present invention is not restricted to these embodiments.

In the present disclosure, the "reference plane" refers to a contact surface that contacts the polishing subject when a polishing material is brought into contact with a flat polishing subject, or in other words, to a plane that is parallel to the surface of the polishing subject. Typically, the reference plane is the substrate surface.

In the present disclosure, the "height" of the three-dimensional element refers to the distance from the bottom surface of the three-dimensional element to the top point or top plane of the three-dimensional element, along a line perpendicular to the reference plane. Typically, the height is determined using the substrate surface as a reference.

The painted surface finishing method of an embodiment of the present disclosure includes providing a surface suitable for finish polishing by removing irregularities in the painted surface, and finish polishing the surface. A polishing material having a polishing layer with a structured surface where a plurality of three-dimensional elements is provided is used for removing irregularities. The polishing layer includes abrasive diamond particles with an average particle size of 0.5 to 5 μm and a binder containing an epoxy resin.

Another embodiment of the present disclosure relates to the polishing material for use on the painted surface.

Figure 1:
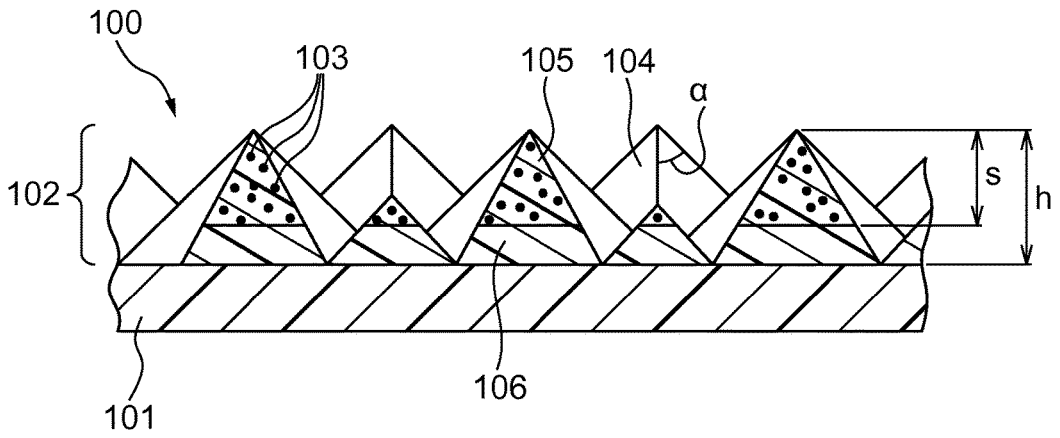
FIG. 1 is a cross-section diagram of the polishing material according to an embodiment of the present disclosure.

An embodiment of the polishing material is illustrated by the cross-sectional diagram in FIG. 1. A polishing material 100 illustrated in FIG. 1 includes a polishing layer 102 with abrasive diamond particles 103 dispersed in a binder containing an epoxy resin on a substrate 101, and the polishing layer 102 has a structured surface where a plurality of three-dimensional elements 104 is provided. The substrate 101 can be attached to the polishing layer 102 through a laminate layer or an adhesive layer. If the binder has an adhesive property, the substrate 101 can be attached to the polishing layer 102 without using a laminate layer or an adhesive layer. The abrasive diamond particles 103 are uniformly or non-uniformly dispersed in the binder. In this embodiment, when a surface of a polishing subject is polished using the polishing material 100, the portion of the polishing material that is in contact with the polishing subject will gradually wear down, depending on the hardness of the polishing subject, and the unused diamond abrasive particles 103 will become exposed.

The polishing layer with a structured surface where a plurality of three-dimensional elements are provided can be formed by filling a mold having a negative pattern of the structured surface using a particle slurry containing abrasive diamond particles dispersed in a binder that is in an uncured or non-gelled condition, and then curing or gelling the binder.

The diamond particles are particles with extremely high hardness, and are generally used for cutting and polishing hard materials such as metals and the like. The painted surface which is the polishing subject of the present disclosure is extremely soft as compared to hard materials such as metal and the like, and therefore it was conventionally thought that using particles with high hardness such as abrasive diamond particles was not necessary. The present inventors discovered that a surface that is suitable for finish polishing at the same time as removing irregularities can be obtained by using abrasive diamond particles for removing the irregularities, contrary to common knowledge of one skilled in the art.

The average particle size of the abrasive diamond particles is approximately 0.5 μm or larger and approximately 5 μm or smaller, and abrasive diamond particles with an average particle size of approximately 1 μm or larger and approximately 4 μm or smaller can be advantageously used. The "average particle size" of the abrasive diamond particles is the volumetric cumulative particle diameter $D_{50}$ measured using a laser diffraction/scattering particle size distribution measurement. The specific measurement conditions are as described below, but other measurement devices and conditions can also be used to the extent that one skilled in the art can understand that similar values can be obtained based on similar principles.

Measuring device: Laser diffraction/scattering particle size distribution measuring device LA-928 (manufactured by Horiba Ltd., Kyoto, Kyoto Prefecture)

Analysis software: LA-920 for Windows (registered trademark)

Amount of particles: 150 mg

Dispersion medium: ion exchange water 150 mL

Recirculation rate (water mixing speed): setting of 15

Ultrasonic oscillation: Yes (using ultrasonic device built into LA-920)

Measurement temperature: room temperature (25° C.)

Relative humidity: 85% or less

He—Ne laser light transmissivity: 85%

Tungsten lamp transmissivity: 85%

Relative refractive index: set to 1.80 (relative refractive index of diamond: 1.81)

Measurement time: 20 seconds

Number of data samples: 10

Particle size basis: volumetric

The maximum particle size of the diamond particles is preferably approximately 20 μm or less, or approximately 10 μm or less. The "maximum particle size" of the diamond particles refers to the diameter if the particles are spherical, to the major diameter if the particles are elliptical, major axis dimension if needle shaped, longest side (triangular) or longest diagonal line (square or larger) if polygonal shaped, and the maximum dimension if other irregular shape.

Although not wishing to be bound to any theory, the abrasive diamond particles can be more firmly held in the binder by using abrasive diamond particles with a relatively small average particle size, and thereby it is thought that a higher grinding force can be demonstrated. Furthermore, abrasive diamond particles with a relatively small average particle size cause less damage to the painted surface, and therefore the depth and size of the depression that occurs after removing irregularities, as well as the region for removing irregularities and the surface roughness of the peripheral region can be reduced.

The binder can be cured or gelled, and contains an epoxy resin. The binder can be thermally cured or radiation cured. The abrasive diamond particles can be more firmly held in the binder and a high grinding force can be demonstrated by using an epoxy resin that has a hardness of the cured material that is higher than that of acrylic resin, as a binder component. Furthermore, the amount of deformation of the three-dimensional elements of the polishing layer can be minimized by increasing the hardness of the binder including the epoxy resin, and thus the energy that is input by hand or a sander can be more efficiently utilized for removing the irregularities.

Examples of the epoxy resin include bisphenol A epoxy resins, bisphenol F epoxy resins, hydrogenated bisphenol A epoxy resins, hydrogenated bisphenol F epoxy resins, alkylene oxide modified bisphenol A epoxy resins, alkylene oxide modified bisphenol F epoxy resins, and other bisphenol epoxy resins; phenol novolac epoxy resins, cresol novolac epoxy resins, and other alkyl phenol novolac epoxy resins; naphthalene backbone modified epoxy resins, methoxy naphthalene modified cresol novolac epoxy resins, methoxy naphthalene dimethylene epoxy resins and other naphthalene epoxy resins; biphenyl epoxy resins, tetramethyl biphenyl epoxy resins, and other biphenyl epoxy resins; cardanol glycidyl ether, cardanol novolac resin, and other cardanol epoxy resins; as well as flame retardant epoxy resins where an epoxy resin has been halogenated, and the like. Bisphenol A epoxy resins, bisphenol F epoxy resins, and cresol novolac epoxy resins, and particularly bisphenol A epoxy resins and cresol novolac epoxy resins, can be advantageously used because of the favorable solubility in organic solvents, and dispersibility of particles. A polishing material filled with a large amount of particles can be efficiently produced by using these epoxy resins.

In addition to the epoxy resin, the binder may also contain, as optional resin components, phenol resins, resole-phenol resins, aminoplast resins, urethane resins, acrylate resins, polyester resins, vinyl resins, melamine resins, isocyanurate acrylate resins, urea-formaldehyde resins, isocyanurate resins, urethane acrylate resins, epoxy acrylate resins, and combinations thereof. The term "acrylate" that is used in the binder includes acrylate and methacrylate. The amount of optional resin components included in the binder is generally approximately 0 mass % or higher, or approximately 1 mass % or higher, and approximately 10 mass % or lower, or approximately 5 mass % or lower, based on the total mass of the binder.

The curable binder can be cured using an energy source such as heat, infrared light, electron beam, ultraviolet light irradiation, visible light irradiation, and the like. The curable binder typically forms a cross-linked structure by radical polymerization or cationic polymerization using a free radical mechanism, or by a condensation reaction or addition reaction. If the curable binder is hardened using ultraviolet light irradiation, a photoinitiator is used. Examples of this type of photoinitiator include organic peroxides, azo compounds, quinones, benzophenones, nitroso compounds, halogenated acrylics, hydrazones, mercapto compounds, pyrylium compounds, triacrylimidazole, bisimidazole, chloroalkyl triazine, benzoin ether, benzyl ketal, thioxanthone, acetophenone, iodonium salts, sulfonium salts, and derivatives thereof. If the epoxy resin is radiation curable, an iodonium salt or a sulfonium salt can be used as the photoinitiator.

The abrasive diamond particles are generally included in the particle slurry at an amount of approximately 150 parts by mass or more, or approximately 200 parts by mass or more, and approximately 1000 parts by mass or less, or approximately 700 parts by mass or less, based on 100 parts by mass of binder. The photoinitiator is generally included in the particle slurry at an amount of approximately 0.1 parts by mass or more, or approximately 0.5 parts by mass or more, and approximately 10 parts by mass or less, or approximately 2 parts by mass or less, based on 100 parts by mass of binder.

The particle slurry may also contain coupling agents, packing materials, lubricating agents, dyes, pigments, plasticizers, fillers, release agents, polish assisting agents, and the like as optional components.

The substrate can be made of polyester, polyimide, polyamide, and other polymer films, paper, cloth, metal films, vulcanized fiber, nonwoven material, as well as processed articles thereof and combinations thereof. A transparent substrate is advantageously used for ultraviolet light irradiation if an ultraviolet light curable paints slurry and/or laminate composition is used. The polymer film can be surface treated by flame treatment, corona treatment, plasma treatment, oxidation by ozone or oxidizing acid, sputter etching, and the like, or by a primer treatment using polyethylene acrylic acid or the like.

The thickness of the substrate is generally approximately 15 μm or more, or approximately 60 μm or more, and approximately 500 μm or less, or approximately 350 μm or less. The substrate can be given shape following properties by using elastic material as the substrate.

The substrate may have an adhesive layer on the surface of the side opposite the surface where the three-dimensional elements are provided. For example, an adhesive layer can be formed by applying a pressure sensitive adhesive containing an adhesive polymer to the surface of the substrate. Alternatively, an adhesive layer can be provided on the substrate by applying a single layer film like pressure sensitive adhesive film containing an adhesive polymer or by applying a double-sided adhesive tape or sheet or the like having two pressure sensitive adhesive layers to the surface of the substrate. The thickness of the adhesive layer is not particularly restricted, but is generally approximately 5 μm or more, or approximately 10 μm or more, and approximately 150 μm or less, or approximately 100 μm or less. A peelable liner that protects the adhesive layer until the polishing material is used can be provided on the adhesive layer.

In the embodiment illustrated in FIG. 1, the polishing layer 102 has a structured surface where a plurality of three-dimensional elements 104 is provided. The three dimensional element 104 has a triangular pyramid shape with the side edges connected at the apex. In this case, the top angle $\alpha$ between two of the sides is generally approximately 30° or more, or approximately 45° or more and approximately 150° or less, or approximately 140° or less. The three dimensional element may have a pyramid (square pyramid) shape. In this case, the top angle between two of the sides is generally approximately 30° or more, or approximately 45° or more and approximately 150° or less, or approximately 140° or less.

The top points of the three dimensional elements 104 are generally on a plane that is parallel with the reference plane across essentially the entire surface of the polishing material. In FIG. 1, symbol h represents the height of the three dimensional element from the reference surface. The height h is generally approximately 2 μm or more, or approximately 4 μm or more, and approximately 300 μm or less, or approximately 150 μm or less. The variation of h is preferably approximately 20% or less of the height of the three dimensional elements 104, and more preferably is approximately 10% or less.

The polishing function of the three dimensional elements of the polishing material is demonstrated by the top part 105. With a polishing material having a polishing layer that contains abrasive diamond particles and a binder, the three dimensional elements wear down from the top part during polishing, and unused abrasive diamond particles are exposed. Therefore, the grinding properties or the polishing properties of the polishing material can be enhanced by increasing the concentration of abrasive diamond particles that are present at the top part of the three dimensional elements, and the diamond particles can be effectively used. The base part of the three-dimensional element, or in other words the bottom part 106 of the three dimensional element that is adhered to the substrate normally is not required to have polishing function, and therefore it is acceptable to not include abrasive particles and to be formed only of binder. The bottom part 106 of the three-dimensional elements can also be made only of the laminate layer or the adhesive layer for adhering the substrate 101 and the polishing layer 102.

In FIG. 1, symbol s represents the height of the apex 105 of the three dimensional element, and s can be, for example, approximately 5% or more, or approximately 10% or more, and approximately 95% or less, or approximately 90% or less of the height h of the three dimensional element.

The structured surface of the polishing layer can include various shapes of three-dimensional elements. For example, the three-dimensional element can be, for example, in the shape of a cylinder, elliptical cylinder, prism, hemisphere, semi-elliptical sphere, cone, pyramid, truncated cone, truncated pyramid, as well as a hip roof, and the like. The structured surface may also include a combination of three-dimensional elements with a plurality of various shapes. For example, the structured surface can include a combination of a plurality of cylinders and a plurality of pyramids. The cross-sectional shape of the base part of the three-dimensional element can be different from the cross-sectional shape of the apex. For example, the cross-section of the apex can be round and the cross-section of the base part can be square. The three dimensional element generally has a larger cross-section area for the base part than the cross-section area for the apex. The base parts of the three dimensional elements can be in mutual or alternating contact, or the base parts of adjacent three-dimensional elements can be mutually separated by a predetermined distance.

In one embodiment, the plurality of three-dimensional elements has a shape selected from the group consisting of pyramidal, conical, truncated pyramidal, truncated conical, and combinations thereof. A higher grinding force can be achieved if the shape of the plurality of three-dimensional elements is that of a pyramid such as a triangular pyramid or four sided pyramid, and especially a triangular pyramid.

In several embodiments, the plurality of three-dimensional elements is regularly provided on the structured surface. In the present disclosure, the term "regularly" that is used with regards to providing the three dimensional elements means that the same shape or a similar shape of the three-dimensional elements is repeatedly arranged on the structured surface either in one direction or a plurality of directions on a plane that is parallel to the reference plane. The term one or a plurality of directions on a plane parallel to the reference plane refers to a linear direction, concentric direction, helical (spiral) direction, or a combination thereof.

Figure 2A:
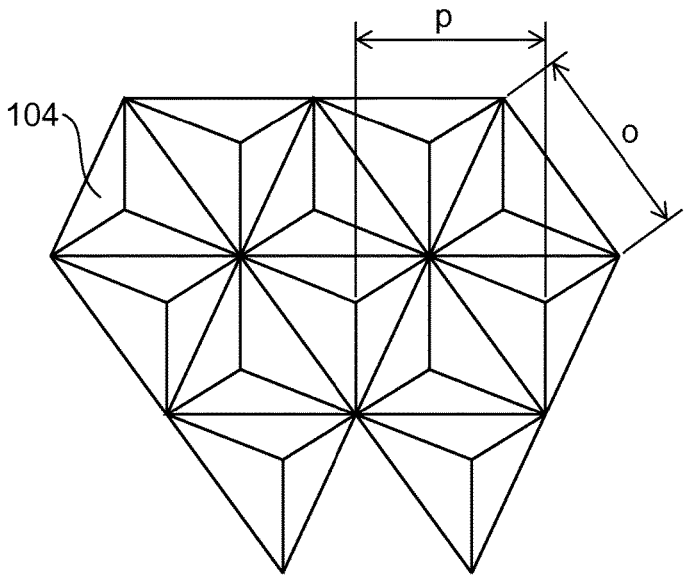
FIG. 2A is a top surface schematic diagram of a structured surface on which a plurality of three-dimensional elements having a triangular pyramid shape is arranged.

FIG. 2A is an upper surface schematic diagram of the structured surface provided with a plurality of three-dimensional elements having a triangular pyramid shape, and corresponds to the upper surface diagram of the polishing material illustrated in FIG. 1. In FIG. 2A, the symbol o represents the length of a bottom edge of the three dimensional element 104, and symbol p represents the distance between the apexes of the three-dimensional elements 104. The length of the bottom edge of the triangular pyramid can be mutually the same or different, and the length of the side edges may also be mutually the same or different. For example, o can be approximately 5 μm or more, or approximately 10 μm or more, and approximately 1000 μm or less, or approximately 500 μm or less, and p can be approximately 5 μm or more, or approximately 10 μm or more, and approximately 1000 μm or less, or approximately 500 μm or less.

Figure 2B:
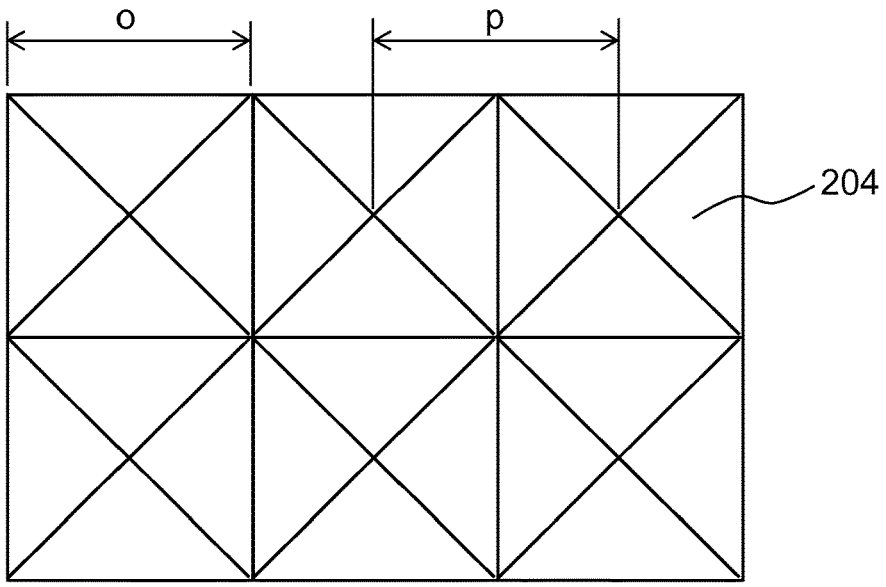
FIG. 2B is a top surface schematic diagram of a structured surface on which a plurality of three-dimensional elements having a square pyramid shape is arranged.

FIG. 2B is an upper surface schematic diagram of the structured surface provided with a plurality of three-dimensional elements having a square pyramid shape. In FIG. 2, the symbol o represents the length of a bottom edge of the three dimensional element 204, and the symbol p represents the distance between the apexes of the three dimensional elements 204. The length of the bottom edges of the square pyramid can be mutually the same or different, and the length of the side edges can also be mutually the same or different. For example, o can be approximately 5 μm or more, or approximately 10 μm or more, and approximately 1000 μm or less, or approximately 500 μm or less, and p can be approximately 5 μm or more, or approximately 10 μm or more, and approximately 1000 μm or less, or approximately 500 μm or less. Although not illustrated in FIG. 2B, the height h of the three dimensional element 204 is generally approximately 2 μm or more, or approximately 4 μm or more, and approximately 600 μm or less, or approximately 300 μm or less. The variation of h is preferably approximately 20% or less of the height of the three dimensional elements 204, and more preferably is approximately 10% or less.

In other embodiments, the three-dimensional elements can be truncated triangular pyramid or truncated square pyramids. The top surface of the three-dimensional elements of these embodiments is generally configured as a triangular shaped or square shaped surface that is parallel to the reference plane. Essentially all of these top surfaces are preferably on a plane that is parallel to the reference plane.

Figure 2C:
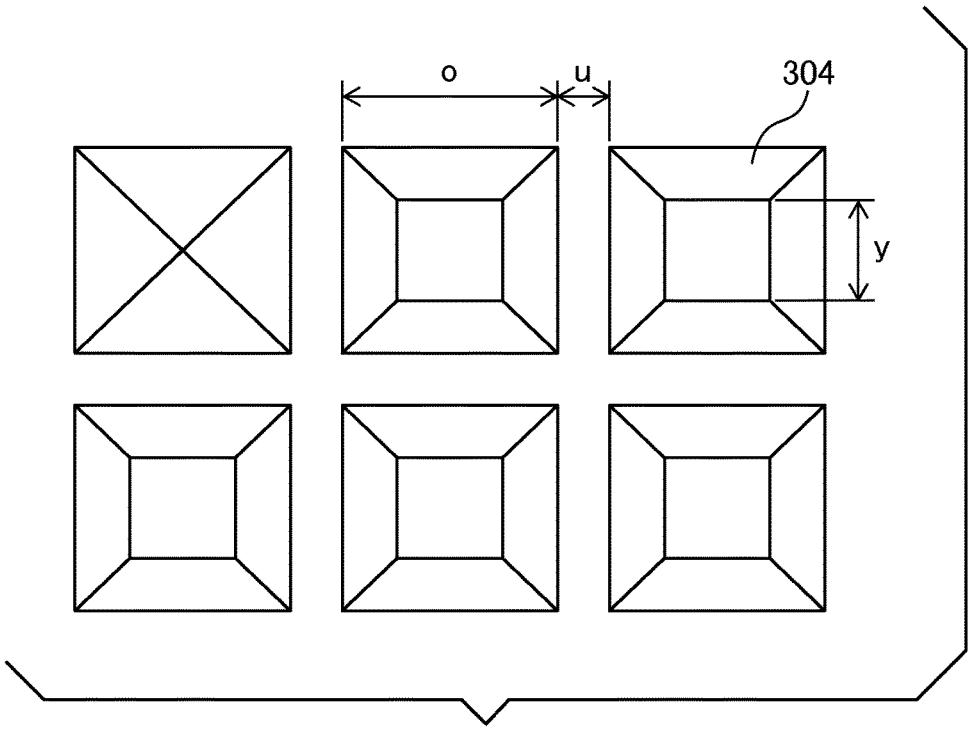
FIG. 2C is a top surface schematic diagram of a structured surface on which a plurality of three-dimensional elements having a truncated square pyramid shape is arranged.

FIG. 2C is an upper surface schematic diagram of the structured surface provided with a plurality of three-dimensional elements having a truncated square pyramid shape. The upper left frame illustrates the shape of the square pyramid before truncating the apex. In FIG. 2C, the symbol o represents the length of the bottom edge of the three dimensional element 304, the symbol u represents the distance between bottom edges of the three-dimensional element 304, and the symbol y represents the length of one edge of the top surface. The length of the bottom edges of the truncated square pyramid can be mutually the same or different, and the length of the side edges can also be mutually the same or different, and the length of the edges of the top surface can also be mutually the same or different. For example, o can be approximately 5 μm or more, or approximately 10 μm or more, and approximately 6000 μm or less, or approximately 3000 μm or less, u can be approximately 0 μm or more, or approximately 2 μm or more, and approximately 10,000 μm or less, or approximately 5,000 μm or less, and y can be approximately 0.5 μm or more, or approximately 1 μm or more, and approximately 6000 μm or less, or approximately 3000 μm or less. Although not illustrated in FIG. 2C, the height h of the three dimensional element 304 is generally approximately 5 μm or more, or approximately 10 μm or more, and approximately 10,000 μm or less, or approximately 5,000 μm or less. The variation of h is preferably approximately 20% or less of the height of the three dimensional elements 304, and more preferably is approximately 10% or less.

Figure 2D:
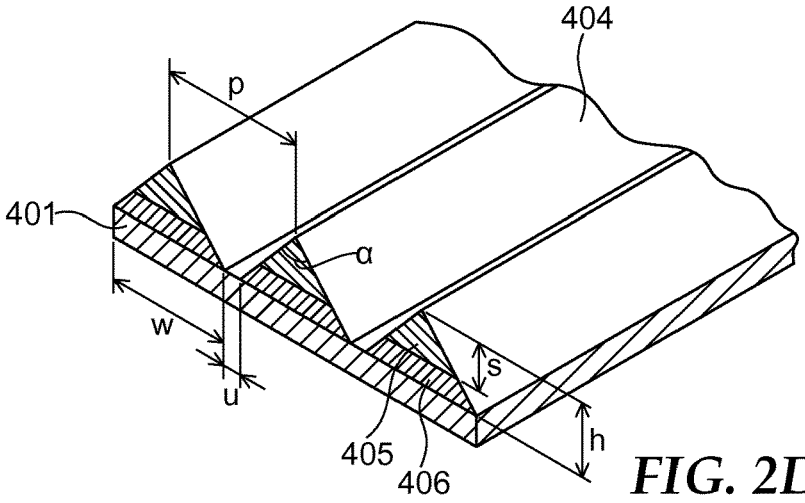
FIG. 2D is a cross-section perspective diagram of a structured surface on which the three-dimensional elements are triangular pillars that have been laid horizontally and aligned.

FIG. 2D is a cross-section perspective diagram of another embodiment, where a plurality of three-dimensional elements 404 are triangular pillars laid horizontally and aligned, and have a ridge line. The three-dimensional elements 404 are provided on a substrate 401, and are illustrated by a 2 layer structure with a three-dimensional element apex 405 containing abrasive diamond particles and binder, and a three dimensional element lower part 406 containing binder but not containing abrasive particles. The ridge line preferably extends on a plane that is parallel to the reference plane across essentially the entire polishing material. In one embodiment, essentially all of the ridge lines are provided on the same plane that is parallel to the reference plane. In FIG. 2D, the symbol a represents the apex of the three dimensional element 404, the symbol w represents the width of the bottom part of the three-dimensional element 404, the symbol p represents the distance between the apexes of the three-dimensional elements 404, the symbol u represents the distance between the long bottom edges of the three-dimensional elements, the symbol h represents the height of the three dimensional element 404 from the surface of the substrate 401, and the symbol s represents the height of the upper part 405 of the three-dimensional element. For example, a can be approximately 30° or more, or approximately 45° or more, and approximately 150° or less, or approximately 140° or less; w is approximately 2 μm or more, or approximately 4 μm or more, and approximately 2000 μm or less, or approximately 1000 μm or less; p can be approximately 2 μm or more, or approximately 4 μm or more, and approximately 4000 μm or less, or approximately 2000 μm or less; u can be approximately 0 μm or more, or approximately 2 μm or more, and approximately 2000 μm or less, or approximately 1000 μm or less; h can be approximately 2 μm or more, or approximately 4 μm or more, and approximately 600 μm or less, or approximately 300 μm or less; and s can be approximately 5% or more, or approximately 10% or more, and approximately 95% or less, or approximately 90% or less of the height h of the three dimensional element 404. The variation of h is preferably approximately 20% or less of the height of the three dimensional elements 404, and more preferably is approximately 10% or less.

The various three-dimensional elements 404 illustrated in FIG. 2D can extend across the entire surface of the polishing material. In this case, both end parts in the long bottom edge direction of the three dimensional element 404 are proximal to the end parts of the polishing material, and a plurality of three-dimensional elements 404 are arranged in a striped form.

In another embodiment, the three dimensional element has a hipped roof shape. A "hipped roof" shape in the present disclosure refers to a three-dimensional shape with a side surface that is configured of two triangles facing each other and two squares facing each other, where the side surfaces of adjacent triangles and the side surfaces of the squares have a common edge, and the edges that share a side surface of the two squares that face each other form a ridge line. The ridge lines are preferably on a plane that is parallel to the reference plane across essentially the entire polishing material. In one embodiment, essentially all of the ridge lines are provided on the same plane that is parallel to the reference plane. The side surfaces of the two triangles or the side surfaces of the two squares can have the same shape, or can be mutually different. Therefore, the bottom surface of the hipped roof shape can be in the form of a square, rectangle, parallelogram, trapezoid, and the like, or a quadrilateral where the length of the four edges are mutually different.

Figure 2E:
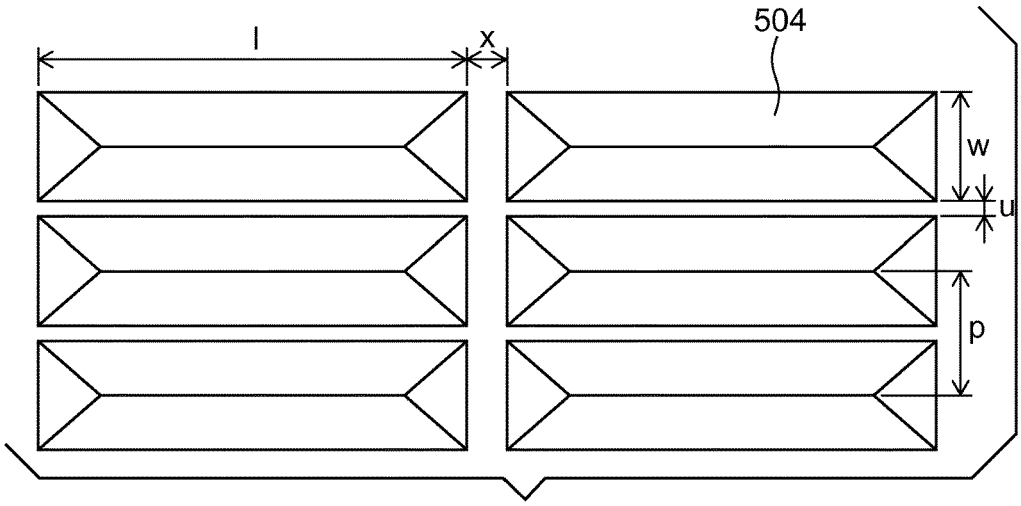
FIG. 2E is a top surface schematic diagram of a structured surface with a plurality of three-dimensional elements having a hipped roof shape.

FIG. 2E is an upper surface schematic diagram of the structured surface provided with a plurality of three-dimensional elements having a hipped roof shape. FIG. 2E illustrates a hipped roof shape having a bottom surface with a rectangular shape. In FIG. 2E, the symbol 1 represents the length of the long bottom edge of the three-dimensional element 504, and the symbol x represents the distance between the short bottom edges of adjacent three-dimensional elements 504. For example, 1 can be approximately 5 μm or more, or approximately 10 μm or more, and approximately 10 mm or less, or approximately 5 mm or less, and x can be approximately 0 μm or more, or approximately 2 μm or more, and approximately 2000 μm or less, or approximately 1000 μm or less. The definition of symbols w, p, and u, and, although not illustrated in FIG. 2E, h, s, and α and the like as well as the exemplary value ranges are the same as described for FIG. 2D.

Figure 2F:
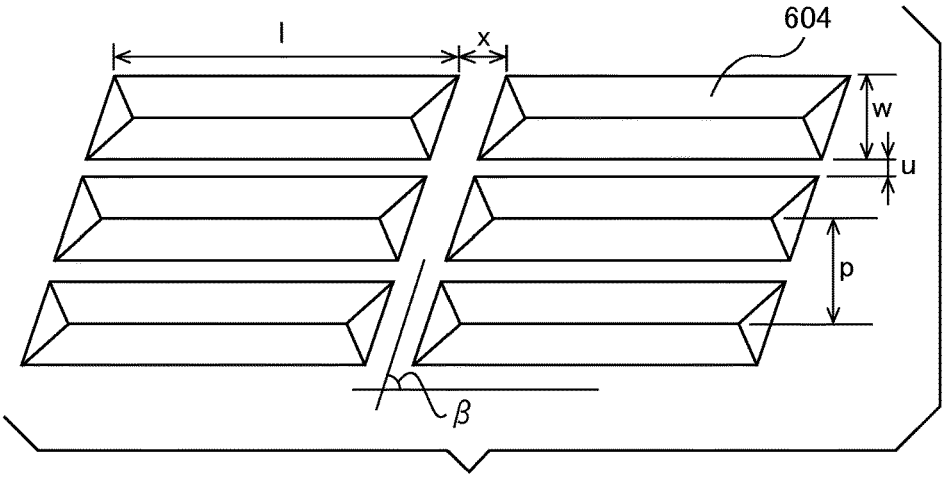
FIG. 2F is a top surface schematic diagram of a structured surface with a plurality of three-dimensional elements having a hipped roof shape, according to another embodiment.

FIG. 2F is an upper surface schematic diagram of the structured surface provided with a plurality of three-dimensional elements having a hipped roof shape according to another embodiment. In this embodiment, the shape of the bottom surface of the hipped roof shape is a parallelogram, and the three-dimensional elements 604 are regularly arranged in the two linear directions that form the angle β. The angle β can be, for example, approximately 30° or more, or approximately 45° or more, and approximately 85° or less, or approximately 75° or less. The definition of symbols l, x, w, p, and u, and, although not illustrated in FIG. 2F, h, s, and α and the like as well as the exemplary value ranges are the same as described for FIG. 2E.

The density of the three-dimensional elements of the polishing material, or in other words the number of three-dimensional elements per square centimeter of polishing material is generally approximately 100 elements/$cm^2$ or more, or approximately 1000 elements/$cm^2$ or more and approximately $1\times10^5$ elements/$cm^2$ or less or approximately $5\times10^4$ elements/$cm^2$ or less.

A favorable manufacturing method for the polishing material is described below as an example, but the manufacturing method of the polishing material is not restricted thereto.

First, an abrasive particle slurry containing abrasive diamond particles, binder, and solvent is prepared. The abrasive particle slurry may contain a photoinitiator or the like if necessary, and may also contain an amount of a volatile solvent sufficient to provide fluidity to the abrasive particle slurry. By using a volatile solvent, the workability when manufacturing the polishing material, and the shape precision and the like of the three dimensional elements that are formed can be enhanced, while high grinding force can be imparted to the polishing material by the including a large amount of abrasive diamond particles in the polishing layer.

The volatile solvent can dissolve the binder, and an organic solvent that demonstrates volatility between room temperature and 170° C. can be advantageously used. Specific examples of the volatile solvent include methyl ethyl ketone, methyl isobutyl ketone, toluene, xylene, ethanol, isopropyl alcohol, ethyl acetate, butyl acetate, tetrahydrofuran, propylene glycol monomethyl ether, propylene glycol monomethyl ether acetate, and the like. Water can also be advantageously used as another solvent.

Next, a template sheet is prepared with a plurality of depressions with a bottom side having a tapered shape. The shape of the depression should be the inverted shape of the three dimensional element to be formed. The material of the template sheet can be, for example, a metal such as nickel or the like, or a thermoplastic resin such as polypropylene and the like. A thermoplastic resin such as polypropylene or the like can be embossed at the melting temperature in a metal fixture, and therefore a depression of an arbitrary shape can easily be formed. If the binder is a radiation curing resin, a material that is transparent to ultraviolet light or visible light is preferably used as the template sheet.

Figure 3A:
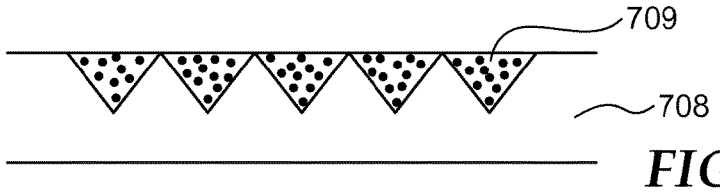
FIGS. 3A-3E show a process chart that schematically illustrates an example of a manufacturing method for a polishing material where the polishing layer has a structured surface.

FIGS. 3A-3E show a process chart schematically showing an example of the manufacturing method for the polishing material where the polishing layer has a structured surface. As shown in FIG. 3A, an abrasive particle slurry 709 is filled into a template sheet 708. The fill amount is an amount that is sufficient to form the apex 105, 405 of the three-dimensional elements illustrated for example in FIG. 1 and FIG. 2D after the volatile solvent has evaporated and the binder has cured. Typically, the fill amount is the amount where the depth from the bottom of the depression of the template sheet is the dimension s shown in FIG. 1 and FIG. 2D, after evaporation of the volatile solvent.

Filling can be performed by applying the abrasive particle slurry to the template sheet using a coating device such as a roller coater or the like. The viscosity of the abrasive particle slurry during application can be approximately 10 Pa·s or higher, or approximately 100 Pa·s or higher and approximately $1\times10^6$ Pa·s or lower or approximately $1\times10^5$ Pa·s or lower.

Figure 3B:
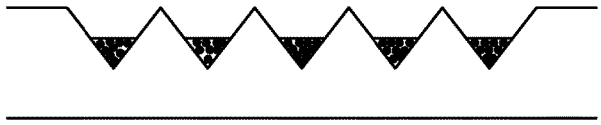

As shown in FIG. 3B, the volatile solvent is removed from the filled particle slurry by evaporation. Typically, the template plate filled with the abrasive particle slurry is heated to 50 to 150° C. Heating is performed for 0.2 to 10 minutes, and if the binder is thermocurable, heating to the curing temperature and curing can be simultaneously performed. If the volatility of the solvent is high, it is also acceptable to leave at room temperature for several minutes to several hours.

Figure 3C:
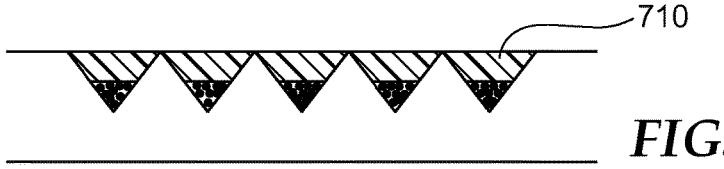

As illustrated in FIG. 3C, the depression is filled with binder by further filling the template sheet with a laminate composition 710. The laminate composition can contain a binder that is the same or different than the binder used in the abrasive particle slurry, and preferably a binder with favorable adhesion to the substrate is used.

The binder of the laminate composition can advantageously be an acrylate resin, an epoxy resin, a urethane resin, or the like. The laminate composition may contain the same photoinitiator as the abrasive particle slurry, as well as other optional components and the like. The filling of the laminate composition can be performed by the same method as the abrasive particle slurry.

Figure 4:
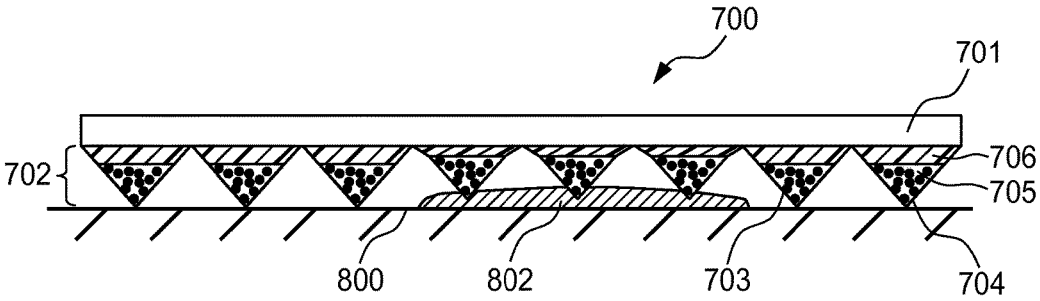
FIG. 4 illustrates removing irregularities using a polishing material with a laminate layer formed using a laminate composition containing a urethane resin.

In one embodiment, the laminate layer contains urethane resin. FIG. 4 shows the removal of irregularities using a polishing material with a laminate layer formed using a laminate composition containing urethane resin. The laminate layer 706 of FIG. 4 is illustrated as the lower part of the three dimensional element 704. The laminate layer 706 containing the urethane resin has elasticity, and as illustrated in FIG. 4, when the polishing material 700 is in contact with any irregularity 802 that protrudes from the painted surface 800, the laminate layer 706 in the region corresponding to the irregularity receives compressive stress and contracts, and thus the load per unit area that is applied to the painted surface 800 in this region is increased by the reactive force. Therefore, the irregularity is efficiently removed by the high polishing force, while damage to the painted surface can be suppressed.

Figure 3D:
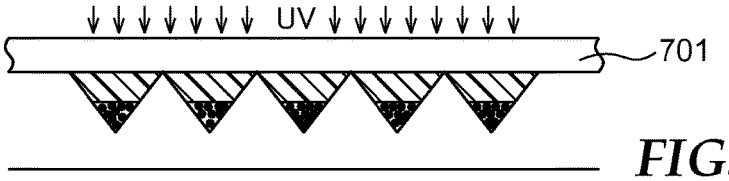

As illustrated in FIG. 3D, the substrate 701 is overlaid on the template sheet 708, and the laminate composition 710 is brought into contact with the substrate 701. The laminate body including the template sheet 708 and the substrate 701 can be compressed using a roller or the like when bringing into contact.

Later, the binder is cured. Curing of the binder of the abrasive particle slurry and the binder of the laminate composition can be performed separately, or can be performed simultaneously.

The binder is cured by heating, or by irradiating with infrared light, electron beam, ultraviolet light, or visible light. The temperature during heating or the amount of radiation energy that is applied can be appropriately determined based on the type of binders that are used, the irradiation energy source, and the like. The curing time varies depending on the depth of the depression in the template sheet, the surrounding temperature, the composition of the abrasive particle slurry and the laminate composition, and the like. For example, the binder can be cured by irradiating with ultraviolet light (UV) from above a transparent substrate.

Figure 3E:
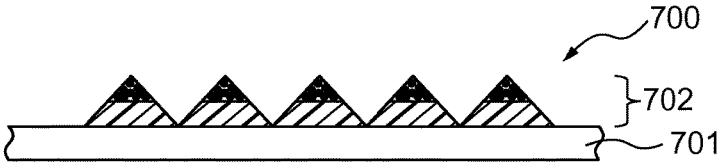

As illustrated in FIG. 3E, the polishing material 700 having a substrate 701 and a polishing layer 702 containing a structured surface can be obtained by removing the template sheet. The binder can also be cured after removing the template sheet.

Irregularities in the painted surface are removed using the polishing material. Removal of irregularities can be performed by a bringing the polishing material attached to an electric or pneumatic driven sander into contact with the irregularity, and moving the polishing material at high speed. Removal of irregularities can also be performed by holding the polishing material by hand, lightly pressing to the irregularity, and then smoothly moving the polishing material back and forth.

Generally, the polishing material is used by cutting to a circle with a diameter of approximately 1 cm or more, or approximately 1.5 cm or more, and approximately 20 cm or less, or approximately 13 cm or less, or to a square shape or rectangular shape where the length of an edge is approximately 1 cm or more, or approximately 1.5 cm or more and approximately 20 cm or less or approximately 13 cm or less.

The polishing material can be directly attached to the polishing surface of the sander, or can be attached to the polishing surface of the sander with an intermediate pad interposed therebetween. The polishing material may have a pressure sensitive adhesive layer for adhering to the intermediate pad or the polishing surface of the sander, and the intermediate pad may have a pressure sensitive adhesive layer for adhering to the polishing surface of the sander and/or the polishing material. The intermediate pad can be made from an elastic compressible material. The irregularity removal efficiency and the surface roughness after removing the regularity can be adjusted by changing the hardness of the intermediate pad.

The polishing surface of the sander can have various motions such as rotational motion, reciprocating motion, orbital (revolution) motion, as well as combinations thereof. For example, several types of commercial double action sanders can combine rotational motion and orbital motion. In a preferred embodiment, the polishing surface of the sander is moved in an orbital manner without rotational motion. In this embodiment, the amount of movement of the polishing material is the same, at any position of the polishing material, and therefore the irregularity removal efficiency can be essentially constant across the entire surface of the polishing material, and the polishing quality can be made uniform, regardless of the proficiency of the operator. The orbital path diameter (orbit diameter) of the orbital motion can be approximately 0.1 mm or more, or approximately 0.5 mm or more, and approximately 20 mm or less or approximately 10 mm or less. The rotational speed of the orbital motion can be approximately 3000 rpm or more, or approximately 5000 rpm or more, and approximately 15,000 rpm or less, or approximately 10,000 rpm or less.

The force applied to the sander when the polishing material is brought into contact with the irregularity will vary depending on the surface area of the polishing material, but is generally approximately 3 kgf or less, preferably approximately 0.5 kgf or more and approximately 2 kgf or less. This force can be varied depending on the size and shape of the irregularity.

If the irregularity is removed by holding the polishing material by hand, the polishing material is preferably moved by a circular motion, generally with a radius of approximately 5 mm or more, or approximately 10 mm or more, and approximately 100 mm or less, or approximately 50 mm or less. Conversely, the polishing material can also be reciprocally moved across a distance of approximately 5 mm or more, or approximately 10 mm or more, and approximately 100 mm or less, or approximately 50 mm or less. The force applied to the polishing material by hand will vary depending on the surface area of the polishing material, but generally is approximately 0.3 kgf or more and approximately 2 kgf or less. This force can be varied depending on the size, shape, and the like of the irregularity.

The irregularities are preferably removed in a condition where water is attached as a lubricating agent to the surface of the polishing material. The generation of powder and the occurrence of clogging of the polishing material can be suppressed by applying water. Furthermore, the surface of the polishing material is preferably cleaned regularly during removal of the irregularities.

With the present disclosure, the surface of the area where the irregularity was removed is suitable for finish polishing. In several embodiments, an Rz of the surface is approximately 0.5 μm or less, approximately 0.2 μm or less, or approximately 0.1 μm or less.

After the irregularity is completely removed, finish polishing is performed in the area where the irregularity was removed and in the peripheral region thereof in order to remove scratches that occurred during removal of the irregularity. Finish polishing can be performed by attaching a buff to an electric or pneumatic driven sander, bringing the buff into contact with the area where finish polishing is to be performed, and then moving the buff at high speed. Finish polishing is preferably performed by applying a polishing compound to the buff surface, the area where finish polishing will be performed, or both.

As the material that forms the buff, various materials can be used such as natural fibers, synthetic fibers, combinations thereof, or foam or the like. The polishing surface of the buff is generally a circle when seen from the direction along the rotational axis of the sander to which the buff is attached, and the polishing surface can be flat, or can be a three-dimensional surface with a plurality of protrusions and depressions. The diameter of the buff is generally approximately 2.5 cm or more, or approximately 5 cm or more, and approximately 20 cm or less, or approximately 13 cm or less. The buff can be made of an elastic compressible material in order to enhance the compatibility to the surface to be polished.

The polishing compound can include abrasive particles, oils or viscosity increasing agents, and petroleum solvents that are dispersed or emulsified in water using a surfactant. The average particle size of the abrasive particles is generally approximately 0.5 μm or more, or approximately 1 μm or more, and approximately 10 μm or less, or approximately 5 μm or less. The mohs hardness of the abrasive particles is generally within a range of 4 to 10. Examples of these abrasive particles can include (sintered) diatomaceous earth, (sintered) kaolin, alumina, colloidal silica, synthetic silica, calcium carbonate, and the like. The oils, viscosity increasing agents, petroleum solvents, and surfactants can be commonly known materials that are included in polishing compounds for paint finishing.

The polishing surface of the sander can have various motions such as rotational motion, reciprocating motion, orbital (revolution) motion, as well as combinations thereof. In a preferred embodiment, the polishing surface of the sander is rotationally moved. In this embodiment, the rotational axis of the rotational motion can freely move across a width of, for example, approximately 1 mm or more, or approximately 5 mm or more, and approximately 30 mm or less, or approximately 20 mm or less. The rotational speed of the rotational motion can be approximately 3000 rpm or more, or approximately 5000 rpm or more, and approximately 15,000 rpm or less, or approximately 10,000 rpm or less.

With the present disclosure, the painted surface can be finished without performing rough polishing, but if necessary, rough polishing can be performed after removing the irregularities. Rough polishing can be performed using a buff and polishing compound with a higher polishing force than finish polishing, for example a polishing compound containing abrasive particles with a larger average particle size.

The method and polishing material of the present disclosure can be used for finishing a painted surface, and particularly for finishing the painted surface of an automobile. Furthermore, the method and polishing material of the present disclosure can also be used for removing irregularities and surface finishing, not only for surface finishing of a painted surface after a topcoat process (clearcoat process), but also for an intermediate process such as a middle coat painting process.

EXAMPLES

In the following examples, a specific embodiment of the present disclosure is presented, but the present invention is not restricted thereto. Parts and percentages are all based on mass, unless otherwise specifically noted.

The materials and devices used in the present example are presented in the following Table 1.

TABLE 1

| Product Name or Abbreviation | Description | Supplier |
|---|---|---|
| LS6BXF2-3 | Diamond abrasive particles (average particle size 2 μm) | LANDS Superabrasives, Co. (New York, New York, USA) |
| LS6BXF3-5 | Diamond abrasive particles (average particle size 4 μm) | LANDS Superabrasives, Co. (New York, New York, USA) |
| GC#6000[1)] | Silicon carbide abrasive particles (average particle size 2 μm) | Fujimi Incorporated (Kiyosu-shi, Aichi-ken, Japan) |
| GC#3000[1)] | Silicon carbide abrasive particles (average particle size 5 μm) | Fujimi Incorporated (Kiyosu-shi, Aichi-ken, Japan) |
| YDCN-700-10 | Epoxy resin | Nippon Steel & Sumikin Chemical Co., Ltd. (Chiyoda-ku, Tokyo, Japan) |
| Takenate (TM) L-2760 | Urethane resin | Mitsui Chemical Co., Ltd. (Minato-ku, Tokyo, Japan) |
| Curazole (TM) 2MZ | 2-methyl imidazole | Shikoku Chemicals Co., Ltd. (Marugame-shi, Kagawa-ken, Japan) |
| Aronix (TM) M-101A | Diacrylate monomer | Toagosei Co., Ltd. (Nagoya-shi, Aichi-ken, Japan) |
| Irgacure (TM) 907 | Photoinitiator | BASF Japan Co., Ltd. (Minato-ku, Tokyo, Japan) |
| Ripoxy (TM) SP-1509 | Acrylate monomer | Showa Dendo K. K. (Minato-ku, Tokyo, Japan) |
| AEROSOL (TM) AY-100 | Antifoaming agent | CYTEC Industries (Woodland Park, New Jersey, USA) |
| Dowanol (TM) PM | 1-methoxy-2-propanol | Dow Chemical Japan (Shinagawa-ku, Tokyo, Japan) |
| MEK | Methyl ethyl ketone | Godo Co., Ltd. (Chuo-ku, Tokyo, Japan) |
| Trizact (R) film PSA (with glue) disk roller 466LA A5 | Polishing material, silicon carbide particles (average particle size 5 μm)/acrylic resin | 3M Japan (Shinagawa-ku, Tokyo, Japan) |
| Trizact (R) film PSA (with glue) disk roller 466LA A3 | Polishing material, silicon carbide particles (average particle size 3 μm)/acrylic resin | 3M Japan (Shinagawa-ku, Tokyo, Japan) |
| Trizact (R) film PSA (with glue) disk roller 266LA A2 | Polishing material, alumina abrasive particles (average particle size 2 μm)/acrylic resin | 3M Japan (Shinagawa-ku, Tokyo, Japan) |
| 3M (R) BUTSUTORI sander 3125 | Sander for removing irregularities | 3M Japan (Shinagawa-ku, Tokyo, Japan) |
| 3M (R) Buffing sander 8125 | Sander for finish polishing | 3M Japan (Shinagawa-ku, Tokyo, Japan) |
| 3M (R) Soft pad for 3125 BUTSUTORI sander | Pad for BUTSUTORI sander | 3M Japan (Shinagawa-ku, Tokyo, Japan) |
| 3M (R) Foam buffing pad 13257 | Pad for finish polishing | 3M Japan (Shinagawa-ku, Tokyo, Japan) |
| 3M (R) Polish extra fine | Polishing compound for finish polishing | 3M Japan (Shinagawa-ku, Tokyo, Japan) |

[1)]In accordance with JIS R 6001 (1987 version)

Abrasive particle slurries 1 to 4 were prepared by combining the components shown in the following Table 2.

TABLE 2

(Values are expressed as parts by mass.)

| Component | Particle slurry 1 2 μm Dia | 2 4 μm Dia | 3 2 μm GC | 4 5 μm GC |
|---|---|---|---|---|
| LS6BXF2-3 | 200.0 | | | |
| LS6BXF3-5 | | 200.0 | | |
| GC&6000[1)] | | | 200.0 | |
| GC&3000[1)] | | | | 200.0 |
| YDCN-700-10 | 60.0 | 60.0 | 60.0 | 60.0 |
| AEROSOL (TM) AY-100 | 1.0 | 1.0 | 1.0 | 1.0 |
| Curasol (TM) 2MZ | 3.2 | 3.2 | 3.2 | 3.2 |
| Dowanol (TM) PM | 12.9 | 12.9 | 12.9 | 12.9 |
| MEK | 181.0 | 181.0 | 181.0 | 181.0 |
| Total | 458.1 | 458.1 | 458.1 | 458.1 |

[1)]In accordance with JIS R 6001 (1987 version)

The laminate composition was prepared by combining the components shown in the following Table 3.

TABLE 3

(Values are expressed as parts by mass.)

| Component | Laminate composition A | B |
|---|---|---|
| Aronix (TM) M-101A | 30.0 | 44.1 |
| Takenate (TM) L-2760 | | 37.7 |
| Ripoxy (TM) SP-1509 | 20.0 | 17.3 |
| Irgacure (TM) 907 | 1.0 | 0.9 |
| Total | 51.0 | 100.0 |

A polypropylene template sheet was prepared with depressions having a shape of an inverted three-dimensional element as shown in Table 4. Abrasive particle slurries 1 through 4 were applied to a template sheet by a roller coater, and then dried for 3 minutes at 75° C. Laminate composition A or B was applied thereon, a transparent polyester film with a thickness of 75 μm was overlaid as a substrate, and then compressed with a roller to laminate. Ultraviolet light was irradiated from the side of the polyester film in order to cure the laminate composition. Next, the binders of the abrasive particle slurry and the laminate composition were cured by heating for 24 hours at 70° C.

A double-sided pressure sensitive adhesive sheet FAS E-8 (procured from Avery Dennison, Glendale, Calif., USA) was applied onto the polyester film, the template sheet was removed, and then cooling was performed to room temperature to obtain polishing materials 1 through 7 having a pressure sensitive adhesive layer on the surface opposite the structured surface. The polishing layer of the polishing materials 1 through 7 has a structured surface where a plurality of three-dimensional elements are provided, as shown in Table 4.

TABLE 4

| | | Polishing Material 1 Tricut 2 μm Dia | Polishing Material 2 OFF-50 2 μm Dia | Polishing Material 3 Scribe 2 μm Dia | Polishing Material 4 Tricut 4 μm Dia | Polishing Material 5 Tricut 2 μm GC | Polishing Material 6 Tricut 5 μm GC | Polishing Material 7 Tricut 2 μm Dia |
|---|---|---|---|---|---|---|---|---|
| Abrasive particle slurry | | 1 | 1 | 1 | 2 | 3 | 4 | 1 |
| Laminate composition | | A | A | A | A | A | A | B |
| Corresponding diagram | | FIG. 1/2 A | FIG. 2D | FIG. 2F | FIG. 1/2 A | FIG. 1/2 A | FIG. 1/2 A | FIG. 1/2 A |
| Dimensions of each part | h | 63 μm | 25 μm | 55 μm | 63 μm | 63 μm | 63 μm | 63 μm |
| | p | 146 μm | 50 μm | 50 μm | 146 μm | 146 μm | 146 μm | 146 μm |
| | o | 130 μm | | | 130 μm | 130 μm | 130 μm | 130 μm |
| | w | | 50 μm | 40 μm | | | | |
| | u | | 0 μm | 10 μm | | | | |
| | l | | | 280 μm | | | | |
| | x | | | 30 μm | | | | |
| | α | 90° | 20° | 20° | 90° | 90° | 90° | 90° |
| | β | | | 60° | | | | |

The polishing material thereby obtained was cut into a circle with a diameter of 82 mm, and then the irregularity removal performance and the finish polishing suitability were evaluated using the following grinding force test and two-stage polishing test.

Grinding force test. The irregularity removing performance was evaluated by the grinding force test. The procedures are as shown below. The pressure sensitive adhesive layer is exposed by removing the peeling liner from the surface opposite the structured surface of the polishing material, and then affixed to the rotational tester. The material to be polished was a polymethylmethacrylate (PMMA) plate (102 mm diameter circle), and the change in mass of the material to be polished was measured every 1000 polishing cycles under a load of 5 kgf (95 gf/cm$^2$) for a total of 3000 polishing cycles. The results are shown in Table 5. A large change in mass indicates that the grinding force of the polishing material is high, or in other words that excellent irregularity removing performance is demonstrated.

Two-stage polishing test. The surface roughness of the surface that was roughened after removing the irregularity and the number of polishing cycles required for finishing by finish polishing the surface without performing rough polishing were evaluated using a two-stage polishing test. The tester used for this test has an arm that securely holds the sander, and a stage for mounting the painted plate. The arm can linearly move the sander (mono directional or reciprocal) in a condition where a load is applied to the sander. The procedures are as shown below. The painted plate was a bonded steel plate (25 cm long×32 cm wide) coated with LX made by Nippon Paint Co., Ltd. (Shinagawa-ku, Tokyo, Japan), and the painted surface was placed upward, and attached to the stage of the tester. A 3125 PSA soft pad was attached to the 3125 sander for removing irregularities, and then one of the polishing materials 1 through 6, 466LA A5, 466LA A3, and 266LA A2 was attached thereon. The polishing surface of the 3125 sander was orbitally moved without rotational movement in a 2 mm diameter circle. Water was provided by spraying onto the polishing surface (structured surface) of the polishing material after the 3125 sander was attached to the arm of the tester, and the painted surface was polished through two cycles (up and back) over a length of 20 cm at a speed of 3 cm/second with a supplied air pressure of 0.4 MPa and a load of 1 kgf.

Next, the orientation of the painted plate was rotated 90° and then the plate was affixed to the stage. The 3125 sander for removing irregularities was removed from the arm, and then an 8125 buffing sander with an attached foam buffing pad 13257 was attached to the arm. The polishing surface of the 8125 sander was rotationally moved around a center axis with a free movement width of 12 mm. Two grams of Polish Extra Fine was uniformly applied to the 13257 pad, and then the painted surface was finish polished by repeatedly passing through in one direction for a length of 20 cm at a speed of 3 cm/s with a supplied air pressure of 0.4 MPa and a load of 1 kgf. The Rz (maximum height) of the painted surface after removing the irregularity but before finish polishing, the number of polishing cycles required to complete finish polishing, and the occurrence of whitening are presented in Table 5.

TABLE 5

| | Ex. 1 | Ex. 2 | Ex. 3 | Ex. 4 | Ex. 5 | Comp. Ex. 1 | Comp. Ex. 2 | Comp. Ex. 3 | Comp. Ex. 4 | Comp. Ex. 5 |
|---|---|---|---|---|---|---|---|---|---|---|
| Polishing material [1] | 1 | 2 | 3 | 4 | 7 | 5 | 6 | 466LA A5 | 466LA A3 | 266LA A2 |
| Laminate composition | A | A | A | A | B | A | A | — | — | — |
| Grinding force test Grinding amount (g) | | | | | | | | | | |
| 0 to 1000 cycles | 0.467 | 0.115 | 0.265 | 0.434 | 0.556 | 0.082 | 0.159 | 0.687 | 0.535 | 0.246 |
| 1001 to 2000 cycles | 0.351 | 0.055 | 0.134 | 0.209 | 0.350 | 0.003 | 0.002 | 0.453 | 0.211 | 0.116 |
| 2001 to 3000 cycles | 0.211 | 0.033 | 0.091 | 0.105 | 0.147 | 0.001 | 0.002 | 0.186 | 0.053 | 0.063 |
| Cumulative grinding amount (g) | | | | | | | | | | |
| To 1000 cycles | 0.467 | 0.115 | 0.265 | 0.434 | 0.556 | 0.082 | 0.159 | 0.687 | 0.535 | 0.246 |
| To 2000 cycles | 0.818 | 0.170 | 0.399 | 0.643 | 0.906 | 0.085 | 0.161 | 1.140 | 0.746 | 0.362 |
| To 3000 cycles | 1.029 | 0.203 | 0.490 | 0.748 | 1.053 | 0.086 | 0.163 | 1.326 | 0.799 | 0.425 |
| 2 stage polishing test | | | | | | | | | | |
| Surface roughness Rz (μm) | 0.015 | 0.029 | 0.019 | 0.026 | 0.015 | 0.008 | 0.011 | 0.47 | 0.31 | 0.25 |
| Number of finish polishing cycles (cycles) | 5 | 4 | 6 | 6 | 5 | 4 | 6 | 14 | 10 | 8 |
| Whitening | None | None | None | None | None | None | None | Yes | Yes | None |

[1] Refer to Table 4 for the polishing material

In examples 1 through 4, the number of polishing cycles required for completing finish polishing were shortened to 6 cycles or less, and a finished surface with high quality was obtained without the occurrence of whitening. Comparative example 2 and comparative example 3 were similar except that the type of binder was different (comparative example 2: epoxy resin, comparative example 3: acrylic resin), and comparative example 1 and comparative example 2 were similar except that the average particle size of the silicon polishing compound particles were different (comparative example 1: 2 μm, comparative example 2: 5 μm). When silicon carbide particles were used, the grinding force was reduced when the binder was changed from acrylic resin (comparative example 3) to a harder epoxy resin (comparative example 2). When an epoxy resin was used as the binder, wearing of the three dimensional elements was lower as compared to acrylic resin, and exposure of new (unused) silicon carbide particles was suppressed, so it is thought that the grinding force was reduced. With comparative example 1 where epoxy resin was used as the binder and the average particle size of the silicon carbide particles was small, the grinding force was even lower than comparative example 2. On the other hand, when abrasive diamond particles were used, a high grinding force was achieved (Example 1) even with an average particle size of 2 μm, unlike the case where silicon carbide particles were used. With example 5 where a laminate layer containing urethane resin was used, a higher initial (0 to 1000 cycles) grinding force was achieved and a high quality finished surface was achieved without the occurrence of whitening, as compared to example 1 which had a structured surface with the same shape.

REFERENCE NUMERALS

100, 700: polishing material
101, 401, 701: base material
102, 702: polishing layer
103, 703: abrasive diamond particles
104, 204, 304, 404, 504, 604, 704: three-dimensional elements
105, 405, 705: three-dimensional element top part
106, 406: three-dimensional element lower part
706: laminate layer (lower part of three-dimensional element)
708: template sheet
709: abrasive particle slurry
710: laminate composition
800: painted surface
802: irregularity

What is claimed is:

1. A painted surface finishing method, comprising:

preparing the painted surface for finish polishing, the painted surface comprising an irregularity comprising a protruding part of a paint with a size of approximately 0.5 to 5 mm, by removing the irregularity using a polishing material comprising a polishing layer having a structural surface where a plurality of three-dimensional elements are provided, wherein the polishing layer comprises abrasive diamond particles with an average particle diameter of 0.5 to 5 μm and a binder containing an epoxy resin; and finish polishing the surface to a Rz of 0.5 μm or less after removing the irregularity without performing a rough polishing step.

2. The method according to claim 1, wherein the plurality of three-dimensional elements has a shape selected from a group comprising pyramidal, conical, truncated pyramidal, truncated conical, and combinations thereof.

3. The method according to claim 1 wherein the abrasive diamond particles have an average particle diameter of 1 μm to 4 μm.

4. The method according to claim 1 wherein the removing the irregularity comprises bringing the polishing material attached to an electric or pneumatic driven sander into contact with the irregularity.

5. The method according to claim 4 wherein a force applied to the sander when the polishing material is brought into contact with the irregularity is 3 kgf or less.

6. The method according to claim 5 wherein water is provided as a lubricating agent to the surface of the polishing material.

7. The method according to claim 6 wherein finish polishing is performed by attaching a buff to an electric or pneumatic driven sander, and bringing the buff into contact with an area of the painted surface where finish polishing is to be performed.

8. The method according to claim 7 wherein a polishing compound is applied to the buff surface, the area of the painted surface where finish polishing is to be performed, or both.

* * * * *